US005115744A

United States Patent [19]

Barber

[11] Patent Number: 5,115,744

[45] Date of Patent: May 26, 1992

[54] EXTREME"G" ACCELERATOR AMUSEMENT RIDE

[76] Inventor: Gerald L. Barber, 10 Whittington Ct., Greenville, S.C. 29615

[21] Appl. No.: 410,717

[22] Filed: Sep. 20, 1989

[51] Int. Cl.[5] ..... A63G 7/00

[52] U.S. Cl. ..... 104/75; 104/67; 104/300

[58] Field of Search ..... 104/27, 28, 53, 55, 104/63, 67, 74, 75, 295, 300, 302, 305

[56] References Cited

U.S. PATENT DOCUMENTS

| | | | |
|---|---|---|---|
| 128,674 | 7/1872 | Taylor | 104/63 |
| 309,689 | 12/1884 | Campbell | 104/63 |
| 716,285 | 12/1902 | St. Clair | 104/75 |
| 888,881 | 5/1908 | Geores | 104/75 |
| 1,101,630 | 6/1914 | Hooper | 104/53 |
| 4,165,695 | 8/1979 | Schwarzkopf | 104/55 |

FOREIGN PATENT DOCUMENTS

| | | | |
|---|---|---|---|
| 5888 | of 1898 | United Kingdom | 104/34 |

*Primary Examiner*—Robert J. Oberleitner
*Assistant Examiner*—S. Joseph Morano
*Attorney, Agent, or Firm*—Dority & Manning

[57] ABSTRACT

An amusement car ride is disclosed which propels a car along a first straight track section, a curved track section having 180 degrees of arc and a second straight track section, in that order. Movement of the car is provided by a d.c. motor under control by a controller for energizing the motor with accelerating speed during movement of the car through the first straight section, constant speed during movement through the curved section and decelerating speed during movement through the second straight section. A tractor device is mounted for movement along the track sections and the car is pivotally mounted at its forward end to the tractor so that the car can pivot as the same moves along the curved section of track. In so pivoting, passengers in the car are subjected to centrifugal force.

4 Claims, 2 Drawing Sheets

EXTREME"G" ACCELERATOR AMUSEMENT RIDE

BACKGROUND OF THE INVENTION

The present invention relates to an amusement ride system and, more particularly, to an amusement ride employing cars containing one or more people along and around a straight and circular track at extreme "G" speeds.

There are many varieties of amusement ride systems employing one or more cars containing one or more passengers along tracks at high speeds. During the ride, the car may be subjected to sudden changes in direction and/or speeds thereby causing undue discomfort to some of the passengers, as they are physically thrown from side to side and against the car structure. In some amusement rides, restraints are built in the cars to harness the human body against such movements and to obviate the prospects of passengers being thrown from a car. While these restraints may be effective for the safety of the passengers, belts and bars utilized in this regard are not effective to eliminate discomfort.

In order to minimize discomfort or even the danger of causing physical injuries, the ride operator is forced to limit the speed of movement of the amusement car and/or to flatten out the curves and vertical angles of movement. These precautions may be such as to lessen the enjoyment of the ride thereby negating the popularity of the ride. An unpopular amusement ride will eventually terminate its operation for economic reasons. In any event, the operator or owner of the amusement ride is in the unfavorable position of having to compromise.

The present invention has been devised to overcome the disadvantages and problems discussed above by providing high speed car amusement without the usually attendant violent motions being imposed upon the passengers. In the present invention, the passengers experience extreme gravity accelerating, centrifugal and decelerating forces while totally held within their seats and not thrown from side to side.

Therefore, it is the principle object of the present invention to enhance the amusement capability of amusement rides by producing extreme high gravity motion upon passenger cars without subjecting the passengers to undue erratic side and forward movements.

Another object of the invention is to increase the enjoyment of car amusement arrangements by imposing high accelerating forces upon passengers without subjecting them to being tossed or pitched about within an amusement car.

SUMMARY OF THE INVENTION

The present invention includes a specifically devised track arrangement for supporting and guiding an amusement car during an amusement ride and a tractor device movably secured to the track and to which an amusement car is pivotally supported for pivotal movement around the axis thereof. The riding orientation of the track directs the amusement car in a first movement along a straight line, and then a curved movement along a curved section of the track, and finally, through a straight movement to a terminal point for the ride.

These motions are provided by a track arrangement which includes a first straight section, beginning at a loading/unloading station whereat passengers may enter or leave the amusement car and having its other end connected to the beginning of a curved section of track along which the amusement car is driven at a constant speed and which is connected at its end to a second straight section of track wherealong the amusement car is decelerated as it arrives at the terminus of the ride at the end of the second straight section.

The amusement car is pivotally mounted at its forward end to a tractor device arranged to follow the track sections and which may support a drive mechanism and control therefor for effecting the various movements or motions described above. The drive means and control therefor is arranged to produce accelerating movement of the car from a starting point at the beginning of the first straight track section, thereby producing high gravity force upon the passengers sitting in the car. Upon entering the curved section of the track, the motion of the tractor device being propelled along the curve imparts centrifugal force to the car by virtue of its pivoting action, thereby subjecting the passengers to continual, unbroken, high gravity forces as the car is swung around the curved section.

When reaching the end of the curved track section, the car faces the opposite direction from which it was activated and enters the second straight section toward the terminus of the amusement ride and is now decelerated to a stop, thereby subjecting the passengers to continuous negative high gravitational force. In this manner, the extreme "G" forces will be continuous and unbroken throughout the entire ride. In all of these motions, each of the passengers are held against the backs of the seats upon which they are sitting by the forces produced, thereby eliminating any prospect for violent movement from side to side or from front to rear, and yet providing the passengers with an exciting ride throughout their travel around the track system.

Other objects and advantages will become apparent from the present invention after reading the following description taken, in conjunction with the drawings wherein FIG. 1 is an isometric view of the amusement ride system arranged in accordance with the present invention;

FIG. 2 is an elevational view of an amusement car adapted for use in the present invention; and FIG. 3 a partial cross-section of the track system showing the front end of an amusement car arranged thereon; and FIG. 4 is an electrical schematic of a circuit for driving and controlling the movement of a car.

DESCRIPTION OF THE PREFERRED EMBODIMENT

Figure 1:
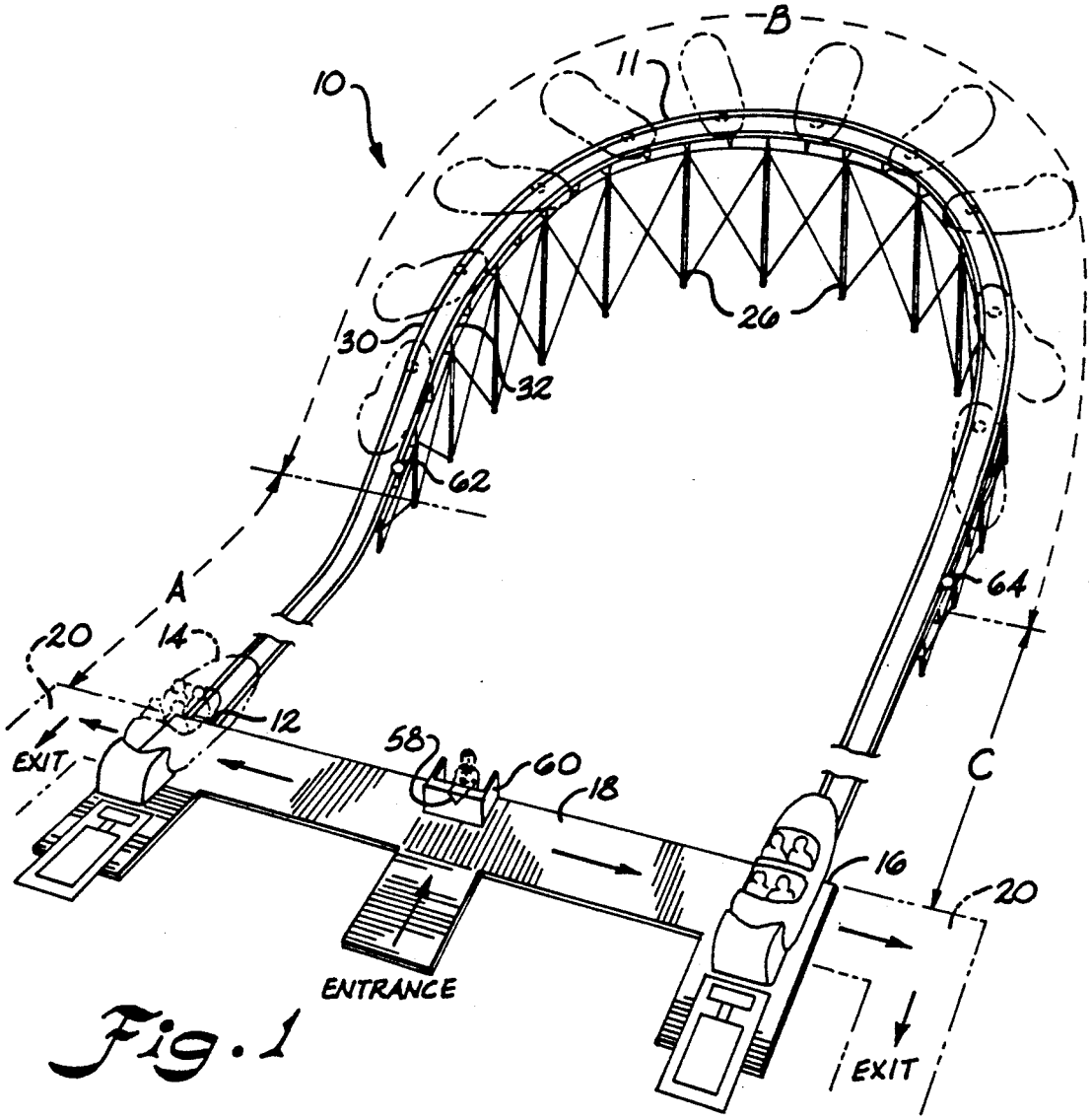

In FIG. 1 of the drawings, the amusement ride system in accordance with the present invention is indicated generally by the reference numeral 10. The system 10 comprises a track system comprising a first straight track section A, a curved track section B connected to the end of the section A, the curvature of which extends 180 degrees of arc, and a second track straight section C connected to the end of the curved section and preferably ending in contiguous alignment with the beginning of the section A.

A loading/unloading station 12 at the entrance end of the straight track section A serves to permit the ingress and egress of one or more passengers to an amusement car 14 when stopped at this station. A straight section A may remain horizontally oriented or rise slightly as its outer end integrates into the beginning of the curved section B. Conversely, the straight section C may assume a horizontal plane or descend slightly after the track leaves the curved section B. Preferably, the section B projects upwardly for the initial arc of curvature reaching its highest elevation at the midpoint thereof and descends in elevation as the arc continues and as the section terminates into the beginning of the second straight track section C.

As shown in FIG. 1, the track system comprising sections A, B, and C is symmetrical, both as to horizontal and vertical orientations. The track section C terminates at a loading/unloading station 16 similar to the station 12 and utilized for the same purpose therefor.

Suitable platforms 18 serve to guide passengers to the stations 12, 16 while other platforms 20 permit the exiting of passengers after completion of an amusement ride within a car 12. As will be described below, an amusement ride comprises a movement of the car 14 from the position shown in FIG. 1 along the track sections A, B, and C, in that order, and terminating when the car reaches the station 16. While at that station 16, the passengers who just experienced the amusement ride, depart from the car, and new passengers are allowed to enter and become seated and secured therein for an amusement ride which now commences at the station 16 and terminates at the station 12. As shown in FIG. 1, the amusement car 14 is oriented as shown for the beginning and ending of each amusement ride, that is, the passengers are facing forward as the ride commences or the ride terminates.

Figure 2:
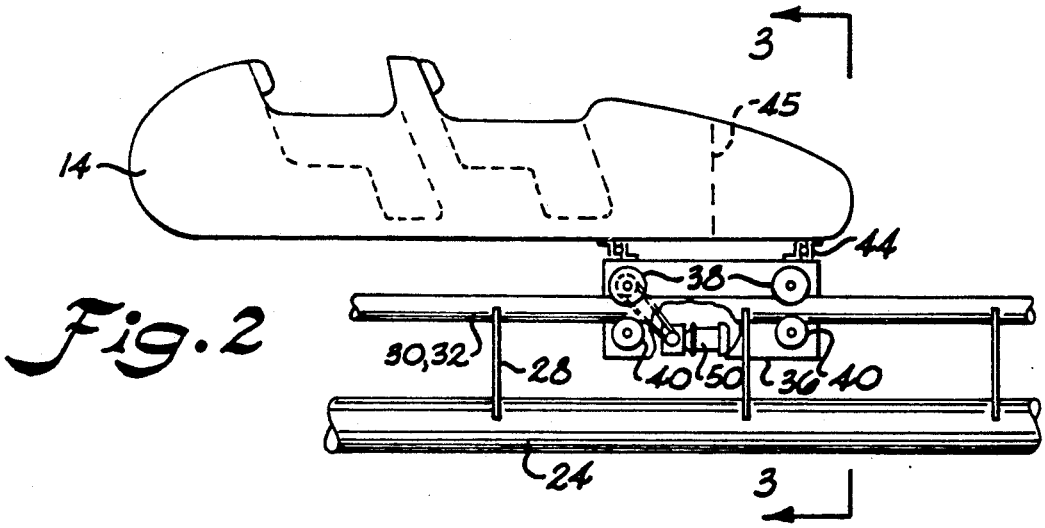
Figure 3:
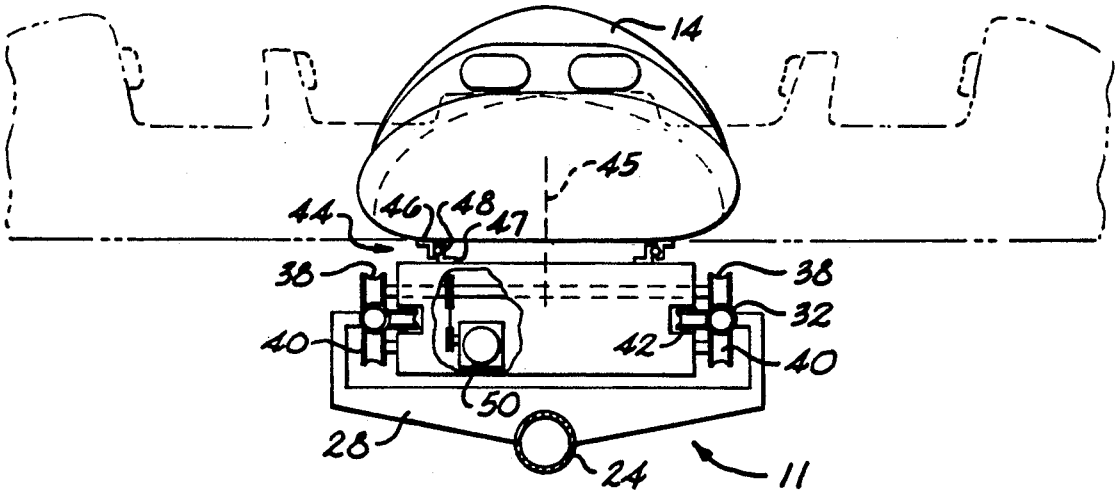

While the track system may comprise any one of the standard varieties presently in use, it is preferred that the same include the structural features illustrated in FIGS. 2 and 3. The track 11 includes a heavy duty structural steel member 24 arranged beginning in the vicinity of the station 12, extending along the sections A, B, and C, and terminating in the vicinity of the station 16. The member 2 is suitably mounted upon upright pillars 26, suitably where structurally necessary along the path of the track system 11. Spaced along the tubular member 24 for the entire length thereof are U-shaped support elements 28 which, in turn, support tubular members 30, 32 having a smaller diameter than the member 24. The members 30, 32 are arranged in parallel and generally in the same plane along the entire length of the track system.

The tubular rail members 30, 32 are arranged to support for movement therealong a tractor device 36 utilized to support, guide and drive the amusement car 14 along the track system. The tractor device 36 is provided with four upper wheels 38 having concave groove rims arranged to seat upon and be supported by the rail members 30, 32. Similarly, four power wheels 40 are arranged upon the tractor and adapted to engage the lower surfaces of the rail members 30, 32 immediately below the wheels 38. The lower wheels 40 prevent inadvertent upper movement of the tractor 36 during an amusement ride, and in effect, when combined with the function of the upper wheels 38, serve to maintain the tractor secured upon the track system except for movement therealong thereby maintaining the safety feature of a car against derailment from the track system. In order to enhance further containment and secured mounting of the tractor device, additional wheels 42 are rotatably mounted on the sides of the tractor device and adapted for engagement with the adjacent sides of the rails 30, 32, thereby preventing sidewise movement of the tractor.

As shown in FIG. 2, the tractor device 36 includes mounting means 44 for securing the car 14 thereon arranged in cantilever orientation and providing a means for permitting the pivotal action of the car along an axis 45. Mounting means 44 comprises large circular rings 46, 47 having ball bearings 48 arranged therebetween. The rings 46, 47 are arranged between the upper surface of the tractor and the lower surface of the car concentric with the axis 45. Other suitable devices such as wheels or rollers arranged in a track system may be utilized for the purpose of supporting the car 14 in view of its cantilever arrangement and the requirement that the car may rotate around the axis 45.

Figure 4:
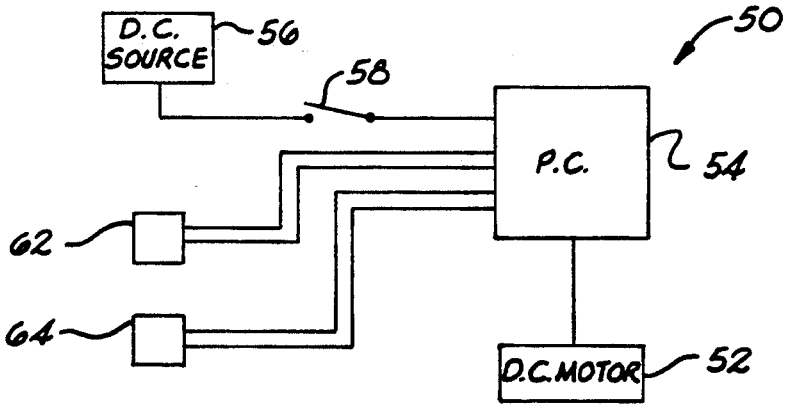

A drive system 50 having a d.c. electric motor 52 and a gear or belt system arranged to provide accelerating, constant speed and decelerating motion is mounted within the tractor 36 for driving the car along the track system 11 in accordance with the present invention. The drive system 50 also includes control circuitry and a programmable controller 54, as shown in FIG. 4, for controlling energization of the electric motor to provide accelerating initial movement of the car 14, constant speed motion upon the car along the curved track section B, and decelerating motion along the straight track section C.

Control is such that energizing voltage for the motor is initiated and gradually increased as a car leaves a station 12 or 16 to provide accelerating movement of the car 14 with extreme "G" force. Upon reaching the curved section B, the control of the energization of the motor 52 is such that the voltage remains constant throughout this section thereby effecting constant speed of the car. When the car reaches the end of the curved section, the voltage to the motor is gradually decreased to effect deceleration of the car. During this action, the lowering of the voltage also serves as a braking action in the movement of the car. Energization of the motor 52 provided from a d.c. source 56 which may be supported within the ride structure and electrically connected to the drive system 50 by way of one or both of the rails 30, 32.

A suitable control switch mechanism 58 is provided at the operator station 60 for initiating the operation of the ride. Sensing devices 62, 64 located respectively at the juncture for the section A with the section B and the section B with the section C are provided to sense the passing of the car 14 and so inform the controller 54 for control purposes. In this manner, the control of the voltage to the motor 52 as aforesaid is made available. With this arrangement, the drive system 50 may be controlled for producing constant speed to the tractor 36 after the same leaves either of the straight sections A, B and to revert back to decelerating motion after leaving the curved section B and entering the appropriate straight section A or C. A drag brake mechanism (not shown) may also be incorporated into the tractor 36 in order to prevent tail waggle during braking action of the tractor as the same decelerates along the straight track section C.

In operation, assuming that a car 14 is at the station 12 whereat passengers from a previous amusement ride may disembark and new passengers may be admitted and conditioned for a subsequent ride, the drive motor 52 is activated preparatory to the commencement of a ride. From the start of movement of the car along the track section A, the same is accelerated at a very high rate of acceleration for the pleasurable experiences of the passengers. In this stretch of movement along the section A, the passengers are forced against the backs of their respective seats by the extreme "G" acceleration produced by the accelerating activity of the drive motor.

Upon reaching the beginning of the curved track section B, the car commences further motion under constant velocity upwardly along the up sloping track section and, as the car is driven the 180 degrees of arc comprising the curved section, the car pivots about the axis 45 as shown in the sequence of car positions along the track section B in FIG. 1. As the car is driven along the curved track section and the pivoting of the same, produces centrifugal force upon the passengers throughout the entire extent of this track section. This centrifugal force continues the extreme "G" force upon the passengers maintaining them against the backs of their seats as was the situation for the track section A but now being produced by centrifugal force rather than accelerating action.

In reaching the end of the curved section B, the car 14 would have turned completely around and is now going backwards as the same is being driven through the track section C. Since motion during movement of the car through the section C is decelerating and since the passengers are now facing forward, the effect on the passengers is a continuation of the extreme "G" force which still forces the passengers against the backs of their respective seats. Throughout the entire ride, the passengers are always maintained under high gravity force against the backs of their seats and are not subjected to violent, erratic changes of motion forward and backwards or from side to side. Rather, the passengers are maintained in their seats and generally held in a constant position throughout the ride but experiences three different forces all of which are under high gravity forces produced by different motions imposed upon the car 14.

When the car reaches the station 16, is in the same orientation as its initial position the station 12 and is in position to unload the pass and to receive new passengers for the next ride. The next ride will be directed from the station 16 to the station 12 and will produce the same pleasurable excitement and sensation upon the passengers as the previous ride accomplished.

It is anticipated that foregoing described amusement ride is capable of imparting an approximately continuous force of five G's upon the passengers in the amusement car. It will be understood that this force may be made variable under control by the operator and by the parameters established for the structural elements of the ride and the power source.

While a preferred embodiment of the invention has been described using specific terms, such description is for illustrative purposes only, and it is to be understood that changes and variations may be made without departing from the spirit or scope of the following claims.

What is claimed is:

1. An amusement car ride comprising a track for supporting and guiding the movement of an amusement car having a first straight section, a curved section and a second straight section;

a car for carrying one or more passengers thereon and arranged for movement on said track; and drive means operatively associated with said car for imparting accelerating speed movement thereto along said first straight section, generally constant speed movement along said curved section and decelerating speed movement along said second straight section.

2. The amusement car ride as defined in claim 1 wherein said drive means includes a tractor device arranged to be driven on said track and means for pivotally supporting said car on said tractor device.

3. The amusement car ride as defined in claim 1 wherein curved section increases in elevation to the midpoint thereof and decreases in elevation to the end thereof.

4. The amusement car ride as defined in claim 1 wherein said curved section extends for approximately 180 degrees of arc thereby effecting a symmetrical track orientation for the car ride.

* * * * *